US006448522B1

(12) United States Patent
Rosen et al.

(10) Patent No.: US 6,448,522 B1
(45) Date of Patent: Sep. 10, 2002

(54) COMPACT HIGH SPEED MOTOR OPERATOR FOR A CIRCUIT BREAKER

(75) Inventors: James Lawrence Rosen, West Hartford; Roger Neil Castonguay, Terryville, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/772,637

(22) Filed: Jan. 30, 2001

(51) Int. Cl.[7] ..... H01H 5/00
(52) U.S. Cl. ..... 200/400; 200/445; 200/322
(58) Field of Search ..... 200/445, 400, 200/401, 327, 321, 322, 330, 331, 332, 332.1, 338; 335/77

(56) References Cited

U.S. PATENT DOCUMENTS

| | | | | |
|---|---|---|---|---|
| 1,848,171 A | * | 3/1932 | Hanel | 200/445 |
| 2,340,682 A | | 2/1944 | Powell | |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,328,731 A | | 6/1967 | Huska | 335/74 |
| 3,517,356 A | | 6/1970 | Hanafusa | 335/16 |
| 3,631,369 A | | 12/1971 | Menocal | 337/110 |
| 3,803,455 A | | 4/1974 | Willard | 317/33 SC |
| 3,883,781 A | | 5/1975 | Cotton | 317/14 R |
| 4,129,762 A | | 12/1978 | Bruchet | |
| 4,144,513 A | | 3/1979 | Shafer et al. | 335/46 |
| 4,152,561 A | | 5/1979 | Maier et al. | |
| 4,158,119 A | | 6/1979 | Krakik | 200/240 |
| 4,165,453 A | | 8/1979 | Hennemann | |

(List continued on next page.)

FOREIGN PATENT DOCUMENTS

| | | |
|---|---|---|
| BE | 819 008 A | 12/1974 |
| BE | 897 691 A | 1/1984 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |

(List continued on next page.)

*Primary Examiner*—Renee Luebke
(74) *Attorney, Agent, or Firm*—Cantor Colburn LLP

(57) ABSTRACT

A motor operator mechanism is disclosed for moving a breaker handle of a circuit breaker between off and on positions. The motor operator mechanism comprises of a first pin biased to engage the breaker handle in a direction to close the circuit breaker, a pin latch configured to releasably engage the first pin when the breaker handle is in a position intermediate to the off and on positions, wherein releasing the pin latch allows the first pin to move the breaker handle to the on position.

16 Claims, 9 Drawing Sheets

U.S. PATENT DOCUMENTS

| | | | | |
|---|---|---|---|---|
| 4,166,988 | A | 9/1979 | Ciarcia et al. | 335/9 |
| 4,220,934 | A | 9/1980 | Wafer et al. | 335/16 |
| 4,255,732 | A | 3/1981 | Wafer et al. | 335/16 |
| 4,259,651 | A | 3/1981 | Yamat | 335/16 |
| 4,263,492 | A | 4/1981 | Maier et al. | 200/288 |
| 4,276,527 | A | 6/1981 | Gerbert-Gaillard et al. | 335/39 |
| 4,297,663 | A | 10/1981 | Seymour et al. | 335/20 |
| 4,301,342 | A | 11/1981 | Castonguay et al. | |
| 4,360,852 | A | 11/1982 | Gilmore | 361/98 |
| 4,368,444 | A | 1/1983 | Preuss et al. | 335/166 |
| 4,375,021 | A | 2/1983 | Pardini et al. | |
| 4,375,022 | A | 2/1983 | Daussin et al. | |
| 4,376,270 | A | 3/1983 | Staffen | 335/21 |
| 4,383,146 | A | 5/1983 | Bur | |
| 4,392,036 | A | 7/1983 | Troebel et al. | 200/322 |
| 4,393,283 | A | 7/1983 | Masuda | 200/51.09 |
| 4,401,872 | A | 8/1983 | Boichot-Castagne et al. | |
| 4,409,573 | A | 10/1983 | DiMarco et al. | 335/16 |
| 4,435,690 | A | 3/1984 | Link et al. | 335/37 |
| 4,467,297 | A | 8/1984 | Boichot-Castagne et al. | 335/8 |
| 4,468,645 | A | 8/1984 | Gerbert-Gaillard et al. | 335/42 |
| 4,470,027 | A | 9/1984 | Link et al. | 335/16 |
| 4,479,143 | A | 10/1984 | Watanabe et al. | 358/44 |
| 4,488,133 | A | 12/1984 | McClellan et al. | 335/16 |
| 4,492,941 | A | 1/1985 | Nagel | 335/13 |
| 4,541,032 | A | 9/1985 | Schwab | 361/331 |
| 4,546,224 | A | 10/1985 | Mostosi | |
| 4,550,360 | A | 10/1985 | Dougherty | 361/93 |
| 4,562,419 | A | 12/1985 | Preuss et al. | 335/195 |
| 4,589,052 | A | 5/1986 | Dougherty | 361/94 |
| 4,595,812 | A | 6/1986 | Tamaru et al. | 200/307 |
| 4,611,187 | A | 9/1986 | Banfi | 335/16 |
| 4,612,430 | A | 9/1986 | Sloan et al. | 200/327 |
| 4,616,198 | A | 10/1986 | Pardini | 335/16 |
| 4,622,444 | A | 11/1986 | Kandatsu et al. | 200/303 |
| 4,631,625 | A | 12/1986 | Alexander et al. | 361/94 |
| 4,642,431 | A | 2/1987 | Tedesco et al. | |
| 4,644,438 | A | 2/1987 | Puccinelli et al. | 361/75 |
| 4,649,247 | A | 3/1987 | Pruess et al. | 200/244 |
| 4,658,322 | A | 4/1987 | Rivera | 361/37 |
| 4,672,501 | A | 6/1987 | Bilac et al. | 361/96 |
| 4,675,481 | A | 6/1987 | Markowski et al. | |
| 4,682,264 | A | 7/1987 | Demeyer | 361/96 |
| 4,689,712 | A | 8/1987 | Demeyer | 361/96 |
| 4,694,373 | A | 9/1987 | Demeyer | 361/96 |
| 4,710,845 | A | 12/1987 | Demeyer | 361/96 |
| 4,717,985 | A | 1/1988 | Demeyer | 361/96 |
| 4,733,211 | A | 3/1988 | Castonguay et al. | 335/192 |
| 4,733,321 | A | 3/1988 | Lindeperg | 361/96 |
| 4,764,650 | A | 8/1988 | Bur et al. | |
| 4,768,007 | A | 8/1988 | Mertz et al. | 335/202 |
| 4,771,140 | A | 9/1988 | Fujii et al. | |
| 4,780,786 | A | 10/1988 | Weynachter et al. | 361/87 |
| 4,831,221 | A | 5/1989 | Yu et al. | 200/553 |
| 4,870,531 | A | 9/1989 | Danek | 361/93 |
| 4,883,931 | A | 11/1989 | Batteux et al. | |
| 4,884,047 | A | 11/1989 | Baginski et al. | 335/10 |
| 4,884,164 | A | 11/1989 | Dziura et al. | 361/97 |
| 4,900,882 | A | 2/1990 | Bernard et al. | |
| 4,910,485 | A | 3/1990 | Bolongeat-Mobleu et al. | 335/195 |
| 4,914,541 | A | 4/1990 | Tripodi et al. | 361/94 |
| 4,916,420 | A | 4/1990 | Bartolo et al. | 335/172 |
| 4,916,421 | A | 4/1990 | Pardini et al. | 335/185 |
| 4,926,282 | A | 5/1990 | McGhie | 361/102 |
| 4,935,590 | A | 6/1990 | Malkin et al. | |
| 4,937,706 | A | 6/1990 | Schueller et al. | 361/396 |
| 4,939,492 | A | 7/1990 | Raso et al. | 335/42 |
| 4,943,691 | A | 7/1990 | Mertz et al. | |
| 4,943,888 | A | 7/1990 | Jacob et al. | 361/96 |
| 4,950,855 | A | 8/1990 | Bolongeat-Mobleu et al. | |
| 4,951,019 | A | 8/1990 | Gula | 335/166 |
| 4,952,897 | A | 8/1990 | Barnel et al. | 335/147 |
| 4,958,135 | A | 9/1990 | Baginski et al. | 335/8 |
| 4,965,543 | A | 10/1990 | Batteux | 335/174 |
| 4,983,788 | A | 1/1991 | Pardini | 200/16 R |
| 5,001,313 | A | 3/1991 | Leclerq et al. | |
| 5,004,878 | A | 4/1991 | Seymour et al. | |
| 5,029,301 | A | 7/1991 | Nebon et al. | 335/16 |
| 5,030,804 | A | 7/1991 | Abri | 200/323 |
| 5,057,655 | A | 10/1991 | Kersusan et al. | |
| 5,077,627 | A | 12/1991 | Fraisse | 361/93 |
| 5,083,081 | A | 1/1992 | Barrault et al. | 324/126 |
| 5,095,183 | A | 3/1992 | Raphard et al. | |
| 5,103,198 | A | 4/1992 | Morel et al. | 335/6 |
| 5,115,371 | A | 5/1992 | Tripodi | 361/106 |
| 5,120,921 | A | 6/1992 | DiMarco et al. | 200/401 |
| 5,132,865 | A | 7/1992 | Mertz et al. | 361/6 |
| 5,138,121 | A | 8/1992 | Streich et al. | 200/293 |
| 5,140,115 | A | 8/1992 | Morris | 200/308 |
| 5,153,802 | A | 10/1992 | Mertz et al. | 361/18 |
| 5,155,315 | A | 10/1992 | Malkin et al. | |
| 5,166,483 | A | 11/1992 | Kersusan et al. | |
| 5,172,087 | A | 12/1992 | Castonguay et al. | 335/160 |
| 5,178,504 | A | 1/1993 | Falchi | 411/553 |
| 5,184,717 | A | 2/1993 | Chou et al. | 200/401 |
| 5,187,339 | A | 2/1993 | Lissandrin | |
| 5,198,956 | A | 3/1993 | Dvorak | 361/106 |
| 5,200,724 | A | 4/1993 | Gula et al. | 335/166 |
| 5,210,385 | A | 5/1993 | Morel et al. | |
| 5,239,150 | A | 8/1993 | Bolongeat-Mobleu et al. | |
| 5,260,533 | A | 11/1993 | Livesey et al. | 200/401 |
| 5,262,744 | A | 11/1993 | Arnold et al. | 335/8 |
| 5,280,144 | A | 1/1994 | Bolongeat-Mobleu et al. | |
| 5,281,776 | A | 1/1994 | Morel et al. | |
| 5,296,660 | A | 3/1994 | Morel et al. | |
| 5,296,664 | A | 3/1994 | Crookston et al. | 200/401 |
| 5,298,874 | A | 3/1994 | Morel et al. | 335/8 |
| 5,300,907 | A | 4/1994 | Nereau et al. | 335/172 |
| 5,310,971 | A | 5/1994 | Vial et al. | 200/244 |
| 5,313,180 | A | 5/1994 | Vial et al. | 335/16 |
| 5,317,471 | A | 5/1994 | Izoard et al. | 361/105 |
| 5,323,131 | A * | 6/1994 | Castonguay | 335/68 |
| 5,331,500 | A | 7/1994 | Corcoles et al. | 361/93 |
| 5,334,808 | A | 8/1994 | Bur et al. | |
| 5,341,191 | A | 8/1994 | Crookston et al. | 335/16 |
| 5,347,096 | A | 9/1994 | Bolongeat-Mobleu et al. | |
| 5,347,097 | A | 9/1994 | Bolongeat-Mobleu et al. | |
| 5,350,892 | A | 9/1994 | Rozier | |
| 5,357,066 | A | 10/1994 | Morel et al. | 200/17 R |
| 5,357,068 | A | 10/1994 | Rozier | |
| 5,357,394 | A | 10/1994 | Piney | 361/72 |
| 5,361,052 | A | 11/1994 | Ferullo et al. | 335/172 |
| 5,373,130 | A | 12/1994 | Barrault et al. | |
| 5,379,013 | A | 1/1995 | Coudert | 335/17 |
| 5,424,701 | A | 6/1995 | Castonguary et al. | 335/172 |
| 5,438,176 | A | 8/1995 | Bonnardel et al. | 200/400 |
| 5,440,088 | A | 8/1995 | Coudert et al. | 200/303 |
| 5,444,202 | A * | 8/1995 | Zurcher | 200/400 |
| 5,449,871 | A | 9/1995 | Batteux et al. | 200/401 |
| 5,450,048 | A | 9/1995 | Leger et al. | 335/132 |
| 5,451,729 | A | 9/1995 | Onderka et al. | 200/18 |
| 5,457,295 | A | 10/1995 | Tanibe et al. | 200/293 |
| 5,467,069 | A | 11/1995 | Payet-Burin et al. | 335/42 |
| 5,469,121 | A | 11/1995 | Payet-Burin | 335/16 |
| 5,475,558 | A | 12/1995 | Barjonnet et al. | 361/64 |
| 5,477,016 | A | 12/1995 | Baginski et al. | 200/43.11 |
| 5,479,143 | A | 12/1995 | Payet-Burin | 335/202 |
| 5,483,212 | A | 1/1996 | Lankuttis et al. | 335/132 |
| 5,485,343 | A | 1/1996 | Santos et al. | 361/115 |
| D367,265 | S | 2/1996 | Yamagata et al. | D13/160 |

| | | | | |
|---|---|---|---|---|
| 5,489,755 | A | | 2/1996 | Castonguay et al. |
| 5,493,083 | A | | 2/1996 | Olivier ..... 200/17 R |
| 5,504,284 | A | | 4/1996 | Lazareth et al. ..... 200/50 R |
| 5,504,290 | A | * | 4/1996 | Baginski et al. ..... 200/401 |
| 5,510,761 | A | | 4/1996 | Boder et al. ..... 335/172 |
| 5,512,720 | A | | 4/1996 | Coudert et al. ..... 200/400 |
| 5,515,018 | A | | 5/1996 | DiMarco et al. ..... 335/16 |
| 5,519,561 | A | | 5/1996 | Mrenna et al. ..... 361/105 |
| 5,534,674 | A | | 7/1996 | Steffens ..... 218/154 |
| 5,534,832 | A | | 7/1996 | Duchemin et al. ..... 335/16 |
| 5,534,835 | A | | 7/1996 | McColloch et al. ..... 335/172 |
| 5,534,840 | A | | 7/1996 | Cuingnet ..... 337/1 |
| 5,539,168 | A | | 7/1996 | Linzenich ..... 200/303 |
| 5,543,595 | A | | 8/1996 | Mader et al. ..... 200/401 |
| 5,552,755 | A | | 9/1996 | Fello et al. ..... 335/18 |
| 5,581,219 | A | | 12/1996 | Nozawa et al. ..... 335/132 |
| 5,604,656 | A | | 2/1997 | Derrick et al. ..... 361/187 |
| 5,608,367 | A | | 3/1997 | Zoller et al. ..... 335/132 |
| 5,784,233 | A | | 7/1998 | Bastard et al. ..... 361/36 |
| 6,087,602 | A | | 7/2000 | Bernier et al. |

FOREIGN PATENT DOCUMENTS

| | | |
|---|---|---|
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 506 066 A1 | 3/1992 |
| EP | 0 555 158 | 8/1993 |
| EP | 0 560 697 | 9/1993 |
| EP | 0 567 416 | 10/1993 |
| EP | 0 612 091 A1 | 2/1994 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| SU | 1 227 978 | 4/1986 |
| WO | 92/00598 | 1/1992 |
| WO | 92/05649 | 4/1992 |
| WO | 94/00901 | 1/1994 |

* cited by examiner (OFF)

(ON)

(TRIPPED)

COMPACT HIGH SPEED MOTOR OPERATOR FOR A CIRCUIT BREAKER

BACKGROUND OF THE INVENTION

The present apparatus relates to a motor operator, and, more particularly, to a motor operator for circuit breakers.

The use of motor operators (motor charging mechanisms) to allow the motor-assisted operation of electrical circuit breakers is well known. A motor operator is typically secured to the top of a circuit breaker housing. A linkage system within the motor operator mechanically interacts with a circuit breaker operating handle, which extends from the circuit breaker housing. The linkage system is operatively connected to a motor within the motor operator and a powerful closing spring. The motor drives the linkage system, which, in turn, moves the operating handle to reset/open and charge the closing spring the circuit breaker. The operating handle is moved from off to on by releasing the stored energy in the closing spring which quickly drives the linkage system and handle to turn on the circuit breaker between "on", "off", and "reset" positions, depending on the rotational direction of the motor.

When the handle is moved to the "on" position, electrical contacts within the circuit breaker are brought into contact with each other, allowing electrical current to flow through the circuit breaker. When the handle is moved to the "off" position, the electrical contacts are separated, stopping the flow of electrical current through the circuit breaker. When the handle is moved to the "reset" position, an operating mechanism within the circuit breaker is reset, as is necessary after the operating mechanism has tripped in response to an overcurrent condition in the electrical circuit being protected by the circuit breaker.

Electric circuit breakers of relatively high current carrying capacity utilize large movable contact arm assemblies to carry the current. Moreover, substantial contact pressure is exerted on the movable contact arms by powerful springs in order to achieve intimate electrical contact between the stationary and movable contacts of the rotary circuit breakers. These powerful springs are also used for abrupt separation of the contacts.

When using a motor operator to open or close a circuit breaker, it is desirable to close the circuit breaker contacts as quickly as possible for certain applications. To accomplish this, motor operators typically employ a large closing spring that, when released, can move the operating handle of the circuit breaker from off to on within the required time. Such motor operators must be large in size to contain the large spring and operating mechanism required to move the breaker handle from the off to the on position.

A motor operator must also be designed to prevent damage to the circuit breaker, and to itself, when moving the circuit breaker handle between the reset, off and on positions. In particular, the motor operator and the circuit breaker must be designed such that closing the circuit does not damage the circuit breaker operating mechanism. This is typically achieved by strengthening the motor operator and the circuit breaker so that they may withstand the stress caused by overtravel, or by utilization of limit switches, takeup springs and solenoids to disengage the motor after the handle has reached a desired point. While effective, the use of limit switches, takeup springs and solenoids to disengage the motor requires the use of many components and, therefore, increases the cost of the motor operator and its potential for failure.

BRIEF SUMMARY OF THE INVENTION

These and other drawbacks are overcome by a motor operator mechanism for moving a breaker handle of a circuit breaker between off and on positions. The motor operator mechanism comprising: a first pin biased to engage the breaker handle in a direction to close the circuit breaker; a pin latch configured to releasably engage the first pin when the breaker handle is in a position intermediate to the off and on positions, wherein releasing the pin latch allows the first pin to move the breaker handle to the on position.

BRIEF DESCRIPTION OF THE DRAWINGS

Referring to the exemplary drawings wherein like elements are numbered alike in the several FIGURES.

DETAILED DESCRIPTION OF THE INVENTION

Figure 1:
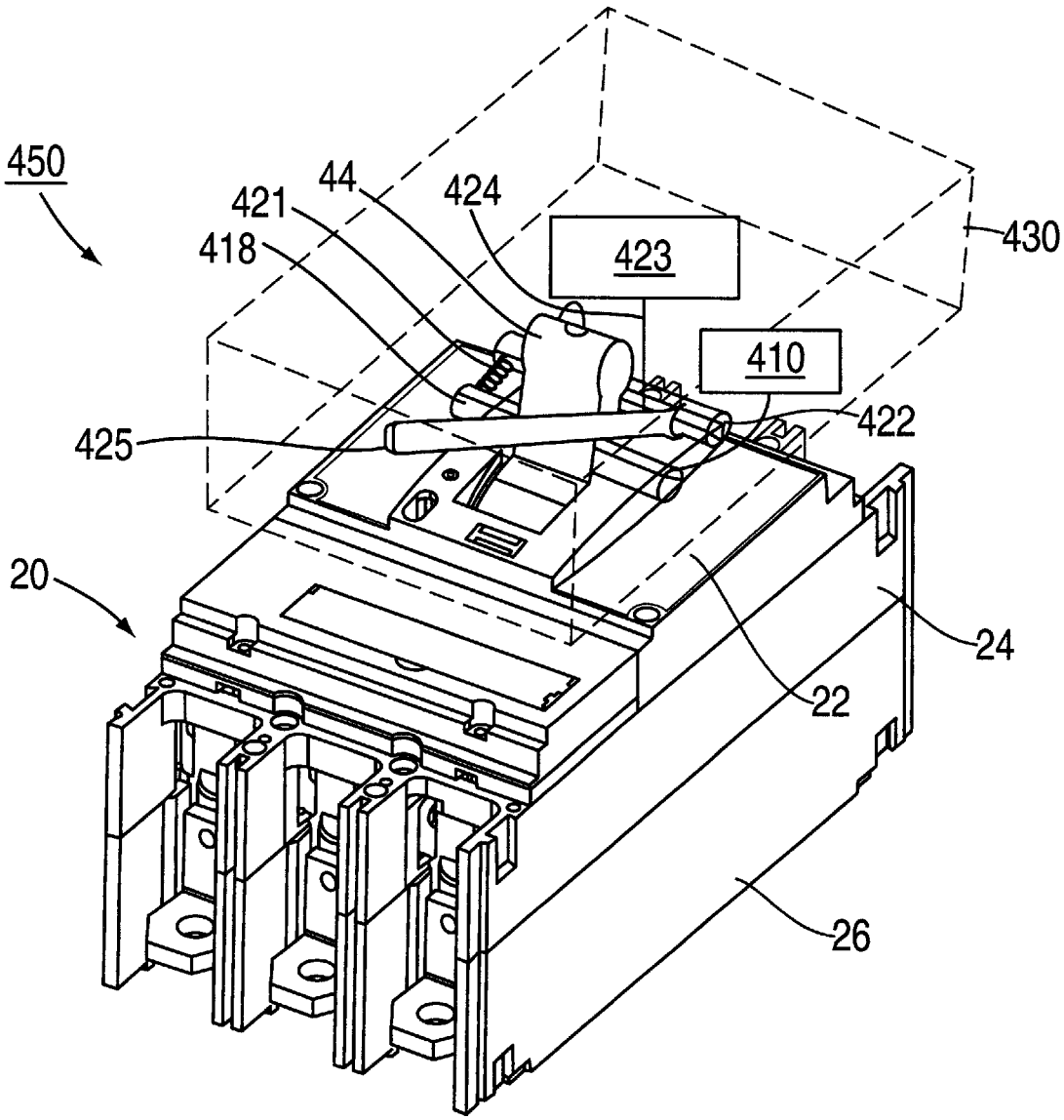
FIG. 1 is an isometric view of a molded case circuit breaker employing an operating mechanism interfaced with a motor operator.
Figure 2:
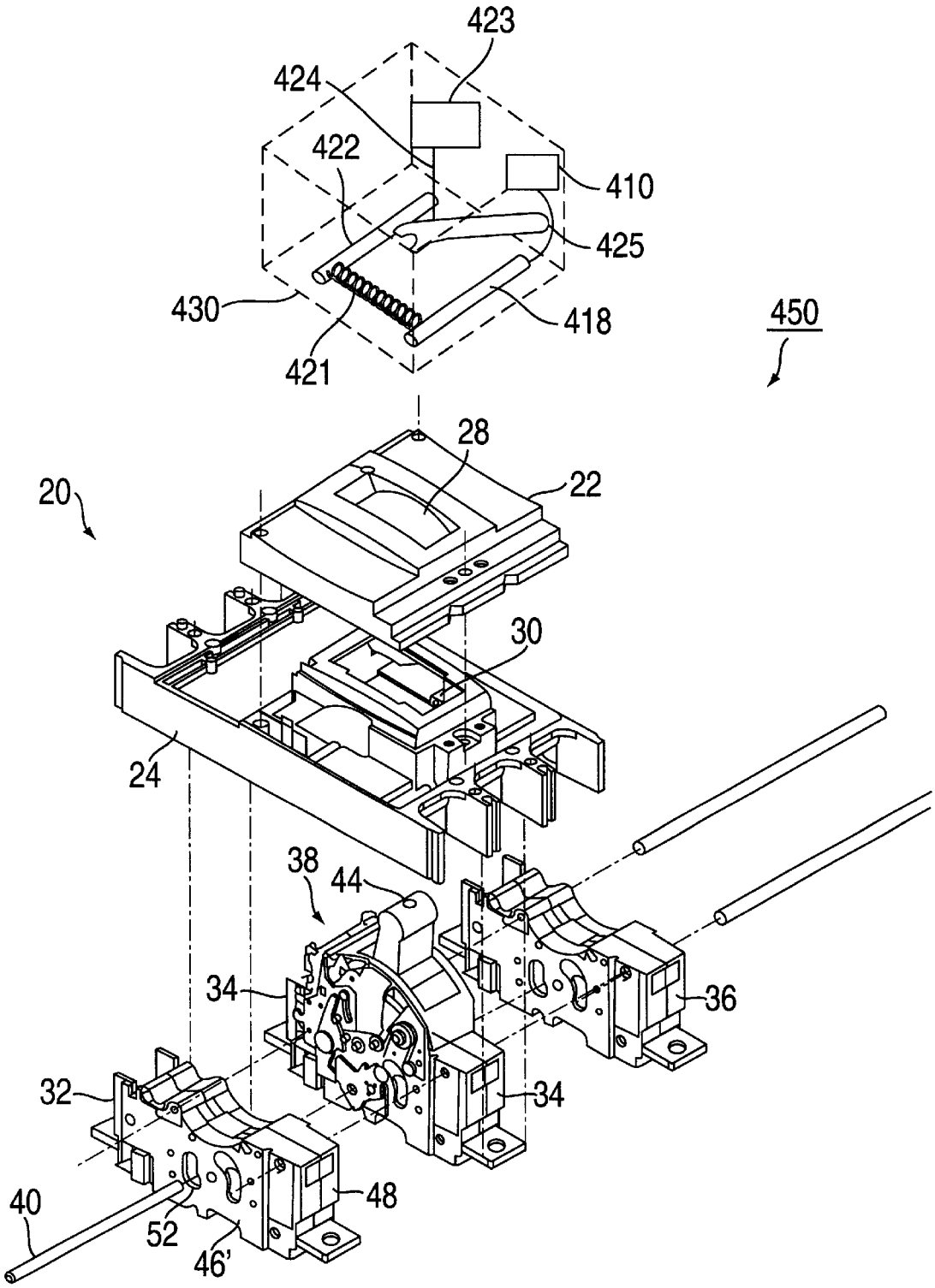
FIG. 2 is a partially exploded view of the circuit breaker and motor operator of FIG. 1.

Referring to FIGS. 1 and 2, a motor operated circuit breaker 450 comprising a circuit breaker 20 interfaced with a motor operator 430. Circuit breaker 20 generally includes a molded case having a top cover 22 attached to a mid cover 24 coupled to a base 26. An opening 28, formed generally centrally within top cover 22, is positioned to mate with a corresponding mid cover opening 30, which is accordingly aligned with opening 28 when mid cover 24 and top cover 22 are coupled to one another. Motor operator 430 generally includes a motor operator mechanism for moving a breaker handle 44 of circuit breaker 20 having a first pin 422 biased against the breaker handle 44 in a closing direction. In a preferred embodiment, first pin 422 is biased with a spring 421 in tension connected to a drive pin 418. The drive pin 418 is driven by means of a drive system 410. The motor operator mechanism further includes a pin latch 425 that pivots about a first end 427 and configured on a second end 429 to releasably engage the first pin when the breaker handle 44 is in a position intermediate to an open and closed position, wherein releasing the first pin 422 allows the biased first pin to move the breaker handle 44 to the closed position. The pin latch 425 is linked to a close mechanism 423 via link 424. The close mechanism 423 causes the pin latch 425 to pivot and thereby release the first pin 422.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. Pat. No. 6,087,913 filed Nov. 20, 1998, entitled "Circuit Breaker Mechanism for a Rotary Contact Assembly".

A breaker handle 44 extends through openings 28 and 30 and allows for external operation of cassettes 32, 34 and 36. Examples of rotary contact structures that may be operated by operating mechanism 38 are described in more detail in U.S. Pat. No. 6,114,641 and application Ser. No. 09/384,908, both entitled "Rotary Contact Assembly For High-Ampere Rated Circuit Breakers", and U.S. Pat. No. 6,175,288, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 3:
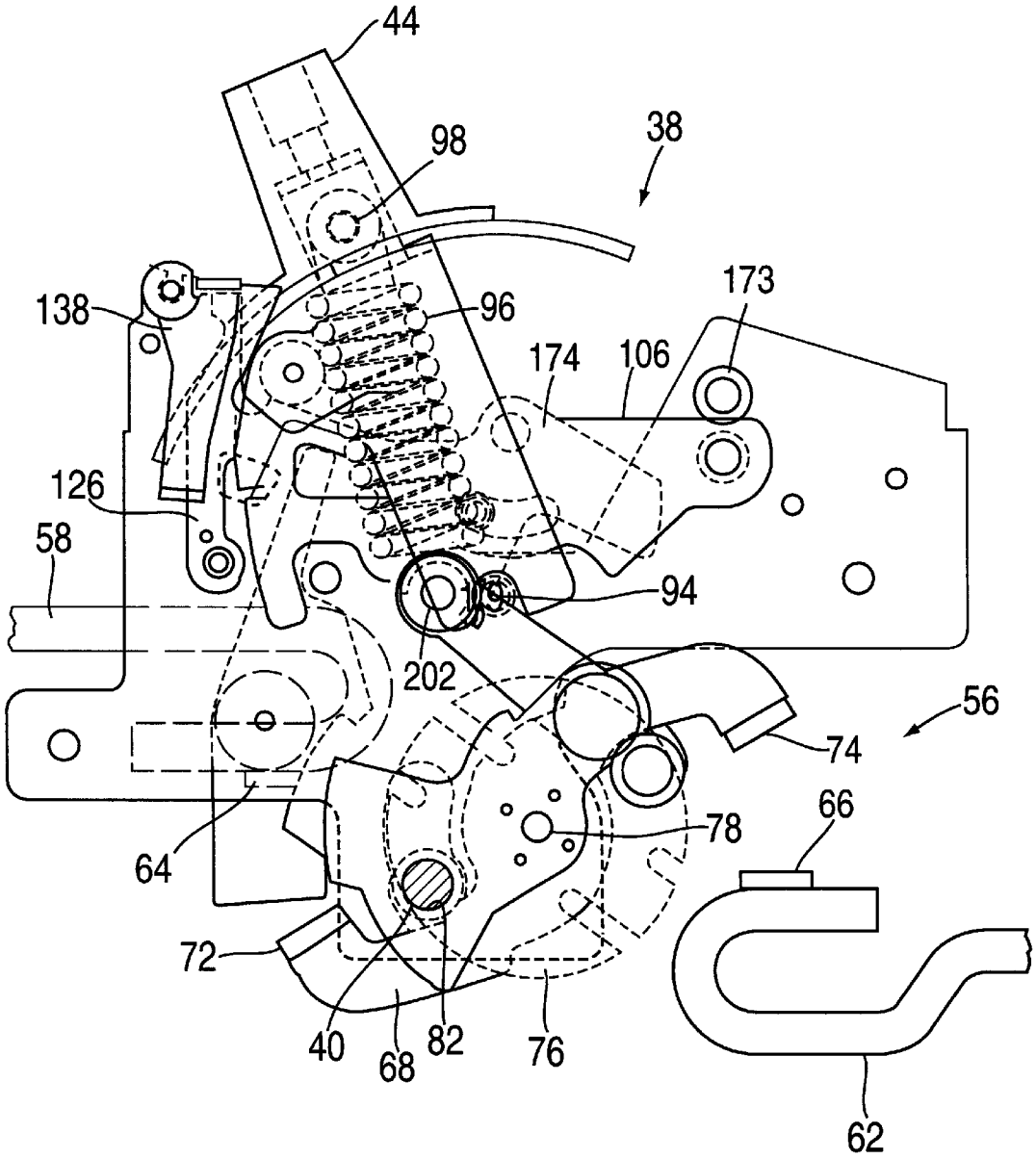
FIG. 3 is a partial sectional view of a rotary contact structure and operating mechanism in the "off" position.
Figure 4:
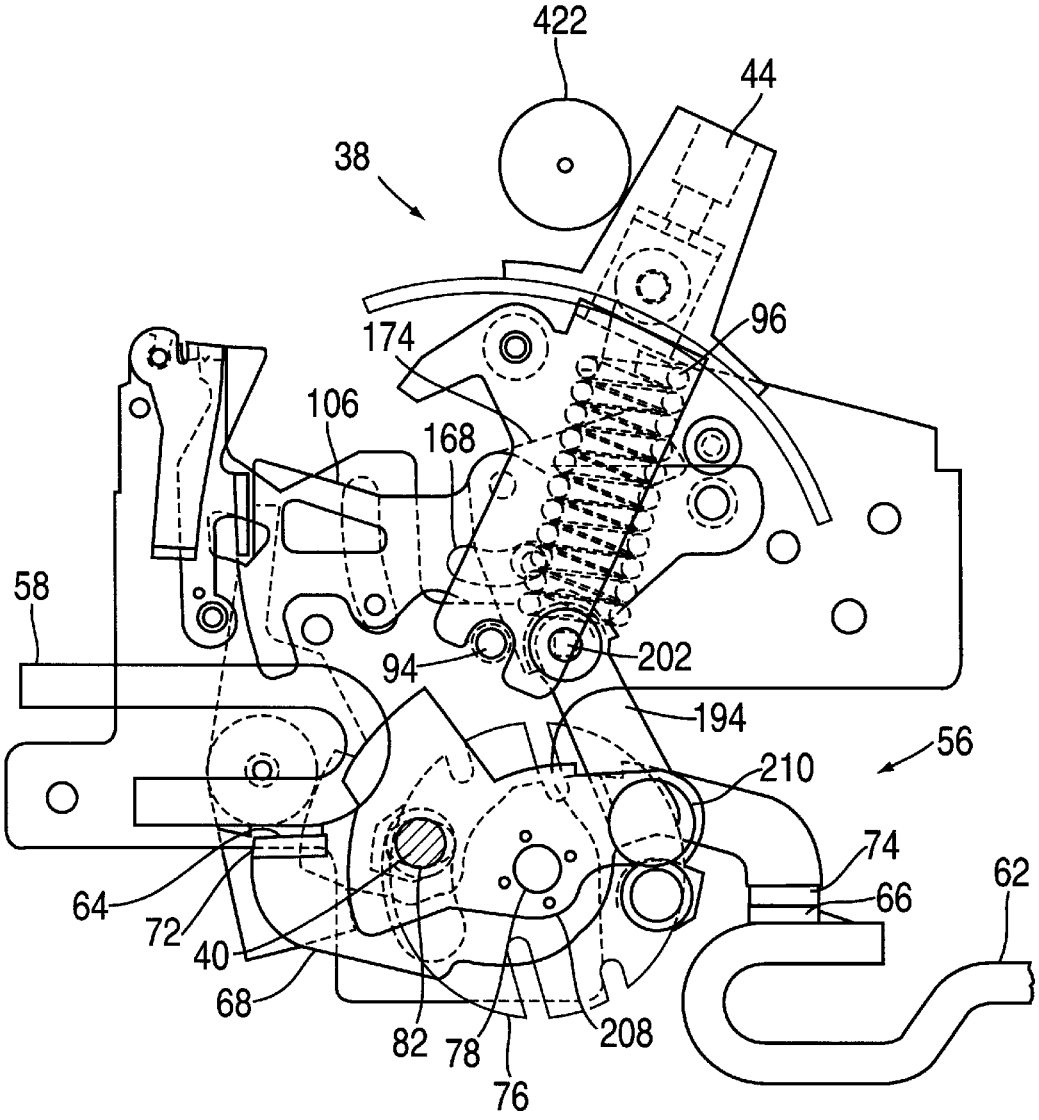
FIG. 4 is a partial sectional view of the rotary contact structure and operating mechanism of FIG. 3 in the "on" position.
Figure 5:
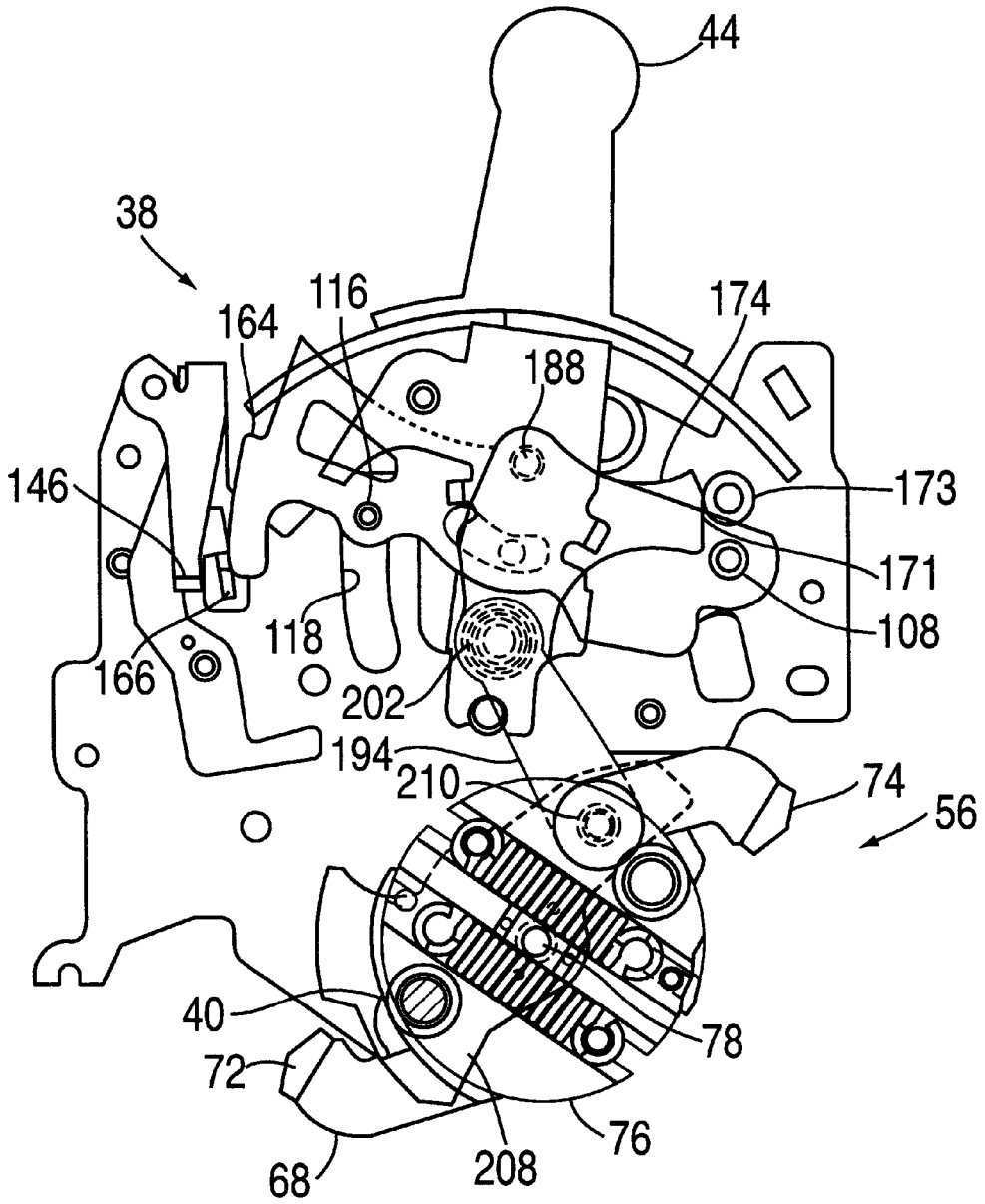
FIG. 5 is a partial sectional view of the rotary contact structure and operating mechanism of FIGS. 3 and 4 in the "tripped" position.

Referring now to FIGS. 3, 4, and 5, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a load side contact strap 58 and line side contact strap 62 for connection with a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively, in an "on" position. In the "off" position (FIG. 3) of operating mechanism 38, wherein breaker handle 44 is oriented to the left (e.g., via a manual or mechanical force), contacts 72 and 74 are separated from stationary contacts 64 and 66, thereby preventing current from flowing through contact arm 68.

In the "on" position (FIG. 4) of operating mechanism 38, wherein breaker handle 44 is oriented to the right as depicted in FIG. 3 (e.g., via a manual or mechanical force), contacts 72 and 74 are mated with stationary contacts 64 and 66, thereby allowing current to flow through contact arm 68. In the "tripped" position (FIG. 5) of operating mechanism 38, breaker handle 44 is oriented between the "on" position and the "off" position (typically by the release of mechanism spring 96 within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move breaker handle 44 to a "reset" condition, which is beyond the "off" position (i.e., further to the left of the "off" position in FIG. 3), and then back to the "on" position. This reset force must be high enough to overcome the mechanism spring 96, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position. The components of operating mechanism 38 are described in more detail in U.S. patent application Ser. No. 09/685,167 entitled "High Energy Closing Mechanism for Circuit Breakers."

Referring back to FIGS. 3–5, the movement of operating mechanism 38 relative to rotary contact assembly 56 will be detailed.

Referring to FIG. 3, in the "off" position breaker handle 44 is rotated to the left and mechanism spring 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surface 164. The line of forces generated by mechanism spring 96 (i.e., between spring anchor 98 and pin 202) is to the left of bearing portion 94 (as oriented in FIGS. 3–5). Cam surface 171 of upper link 174 is out of contact with roller 173.

Referring now to FIG. 4, a manual closing force or mechanical force by way of a biased first pin 422 was applied to breaker handle 44 to move it from the "off" position (i.e., FIG. 3) to the "on" position (i.e., to the right as oriented in FIG. 4). While the closing force is applied, upper link 174 rotates within arcuate slot 168 of cradle 106 about pin 188, and lower link 194 is driven to the right under bias of the mechanism spring 96 in tension. In a preferred embodiment, there should be a suitable space between the surfaces of upper link 174 and cradles 106 to prevent friction therebetween, which would increase the force required to set the operating mechanism 38 from "off" to "on".

Referring now to FIG. 5, in the "tripped" condition, secondary latch trip tab 146 has been displaced (e.g., by an actuator, not shown), and the interface between primary latch 126 and secondary latch 138 is released. Extensions 166 of primary latch 126 are disengaged from cradle latch surfaces 164, and cradle 106 is rotated clockwise about pin 108 (i.e., motion guided by rivet 116 in arcuate slot 118). The movement of cradle 106 transmits a force via pin 188 to upper link 174 (having cam surface 171). After a short predetermined rotation, cam surface 171 of upper link 174 contacts roller 173. The force resulting from the contact of cam surface 171 on roller 173 causes upper link 174 and lower link 194 to buckle and allows mechanism spring 96 to pull lower link 194 via pin 202. In turn, lower link 194 transmits a force to crank 208 (i.e., via rivet 210), causing crank 208 to rotate counter clockwise about center 78 and drive cross pin 40 to the lower portion of an arcuate slot (shown in phantom lines in FIG. 4). The forces transmitted through cross pin 40 to rotary contact assembly 56 via opening 82 cause movable contacts 72, 74 to separate from stationary contacts 64, 66.

Figure 6:
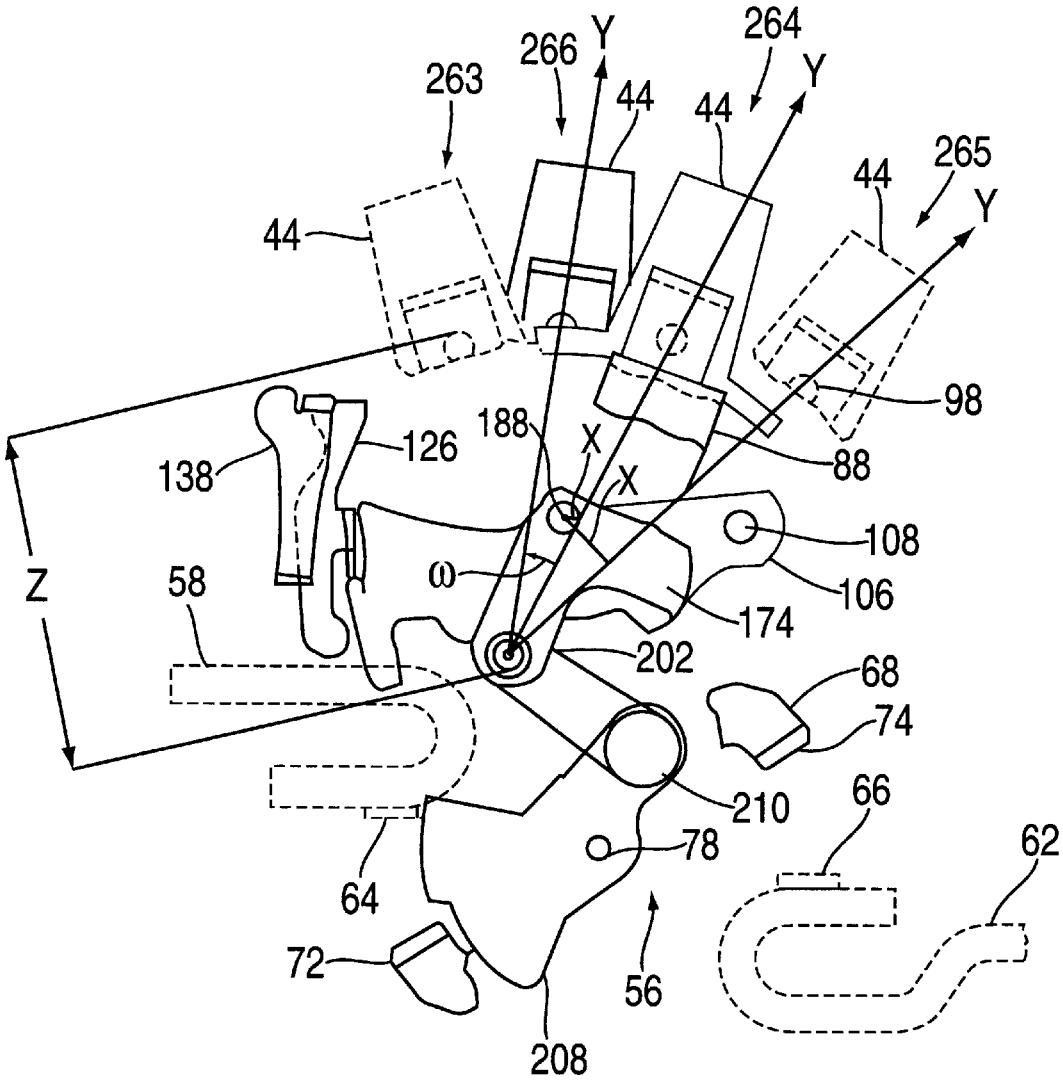
FIG. 6 is a partial sectional view of a rotary structure and operating mechanism in "off," "tripped," and "on" positions.

FIG. 6 shows the movable rotary contact assembly 56 in the "off" (open) position. The "z" distance represents the length of the mechanism (operating) spring 96. As the breaker handle 44 is rotated from position 263 to the position 265, the "z" distance increases, creating greater closing force output within the mechanism spring 96. The closing spring force is always directed through the anchor point of spring 96, spring anchor 98 and pin 202, as depicted by line "y". When the line "y" passes to the right of upper link pivot pin 188, a moment arm of length "x" is created perpendicular to line "y" and through the center of pin 188. When line "y" creates a sufficient moment arm "x" about pin 188, as at the initial close position 264, the upper link 174 will rotate in a counterclockwise direction about pin 188 and close the contact arm 68 as described hereinbefore with reference to FIG. 4. Line "y" placed in the initial closed position 266 will allow the operating mechanism 38 to create a particular amount of closing output.

If line "y" is allowed to go to the "full closed position", the closing output of the mechanism 38 is greatly increased due to the fact that moment arm "x" is a greater length and the length of spring 96, depicted as "z", is also greater. When closing the contacts 64, 72, 74 and 66, the handle 44 is normally rotated to its "full closed position". If the handle 44 is moved to less than the full closed position, then the "x" moment arm is relatively short. Thus, the rate at which the handle 44 is rotated to the full closed position can affect the closing output of the operating mechanism 38.

Figure 7:
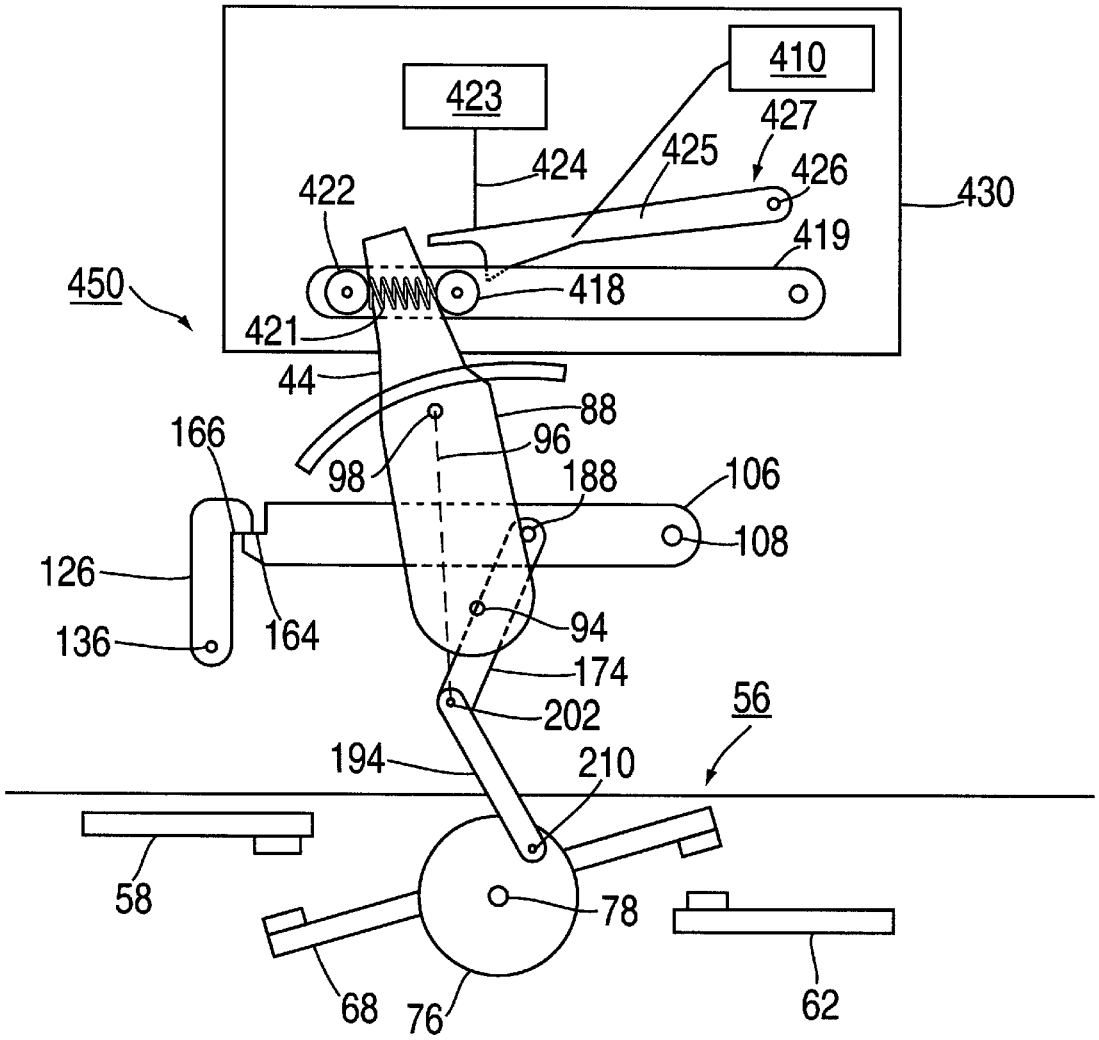
FIG. 7 is a schematic diagram of a motor operator and a circuit breaker of the present apparatus in the off position.

Referring to FIG. 7, a first pin 422 engages breaker handle 44 at an interface formed between the motor operator 430 and the breaker mechanism 38, where the first pin 422 moves breaker handle 44 in a clockwise direction about bearing portion 94 to rotate crank 208 to the closed position in conjunction with mechanism spring 96. First pin 422 is biased in the closing direction. A spring 421 is utilized to bias first pin 422 in an exemplary embodiment. A preferred exemplary embodiment includes the interface having a slot 419 wherein the first pin 422 and drive pin 418 are guided in said slot 419 as shown in FIGS. 7, 8, and 9.

Drive pin 418 (driven by a drive system 410) is connected to a first pin 422 with a spring 421 biasing the first pin 422 against the breaker handle 44 in an interface between the motor operator 430 and the circuit breaker mechanism causing breaker handle 44 to-move towards the closed position. The pin latch 425 pivots about a pin 426 proximate a first end 427 of the pin latch 425. A spring (not shown) biases the pin latch 425 to rotate in a counterclockwise direction about the pin 426. The other end of the pin latch is formed to contact and restrain the first pin 422. The pin latch 425 is connected to a close mechanism 423 with a connecting link 424.

The operation of the motor operator 430 will now be described with reference to FIGS. 7, 8, and 9. FIG. 7 shows a motor operator and circuit breaker mechanism in the "reset" and "off" positions. The breaker handle 44 is attached to a handle yoke 88. The handle yoke 88 is attached to a bearing portion 94, which in turn is fixed to a breaker frame ( not shown). An axis through a spring anchor 98 and bearing portion 94 coinciding with handle yoke 88 position is oriented counterclockwise in relation to a vertical axis passing through bearing portion 94. A breaker mechanism spring 96 is attached to the handle yoke 88 and extends in tension to a pin 202. Pin 202 pivotally connects an upper link 174 and lower link 194. The upper link 174 pivots on a pin 188 that is pivotally attached to a cradle 106. The cradle 106 pivots on one end on a pin 108 that is attached to the breaker frame (not shown). The lower link 194 is secured to a pivotal rivet 210. The pivotal rivet 210 is secured to a rotary contact assembly 56 having arms 68 that is mounted to the breaker frame (not shown) and allowed to rotate around common center 78 in the breaker frame. In the "off" and "reset" position, the rotary contact assembly 56 is pivoted counterclockwise such that arms of rotary contact assembly 56 are not in contact with a line strap 62 and a load strap 58, thus creating an open circuit.

Figure 8:
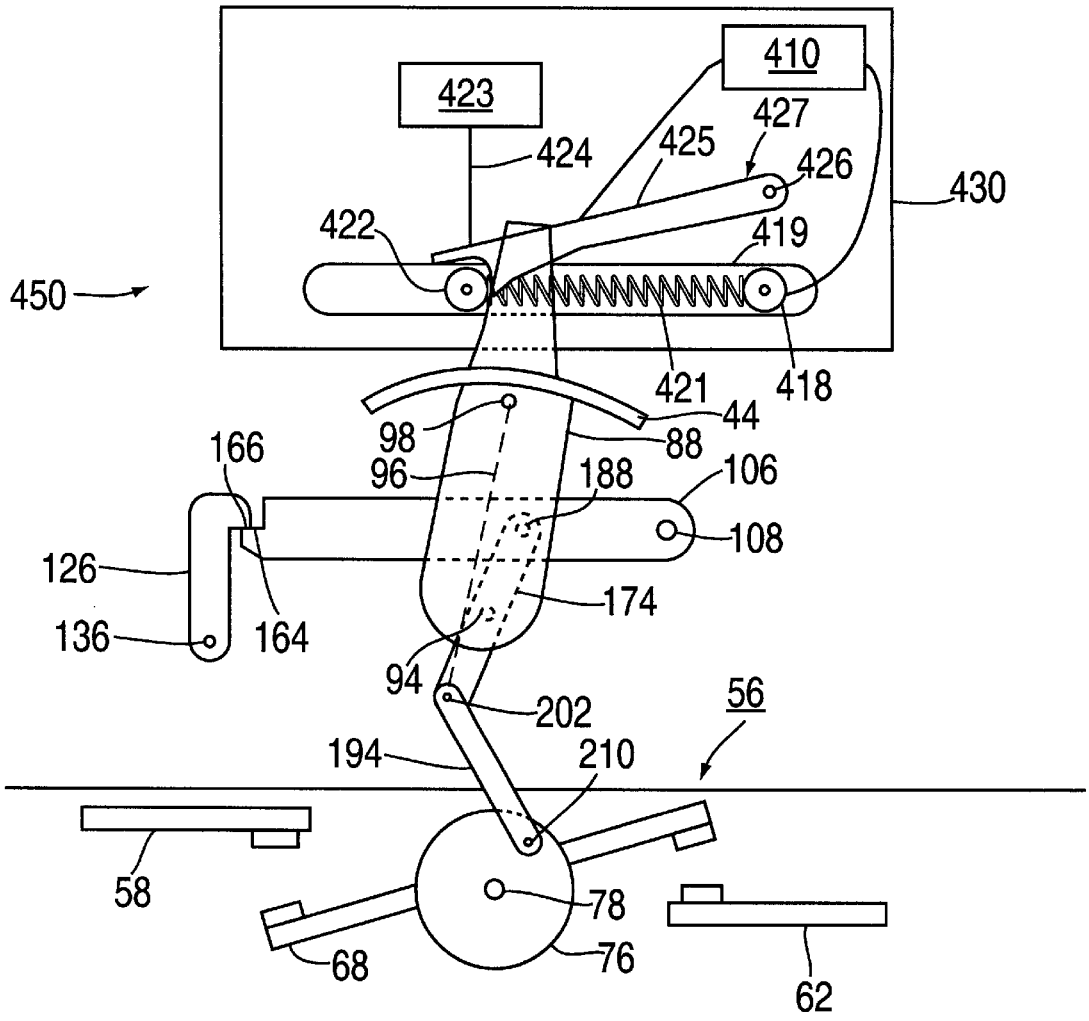
FIG. 8 is a schematic diagram of a motor operator and a circuit breaker of the present apparatus in the ready to close position.
Figure 9:
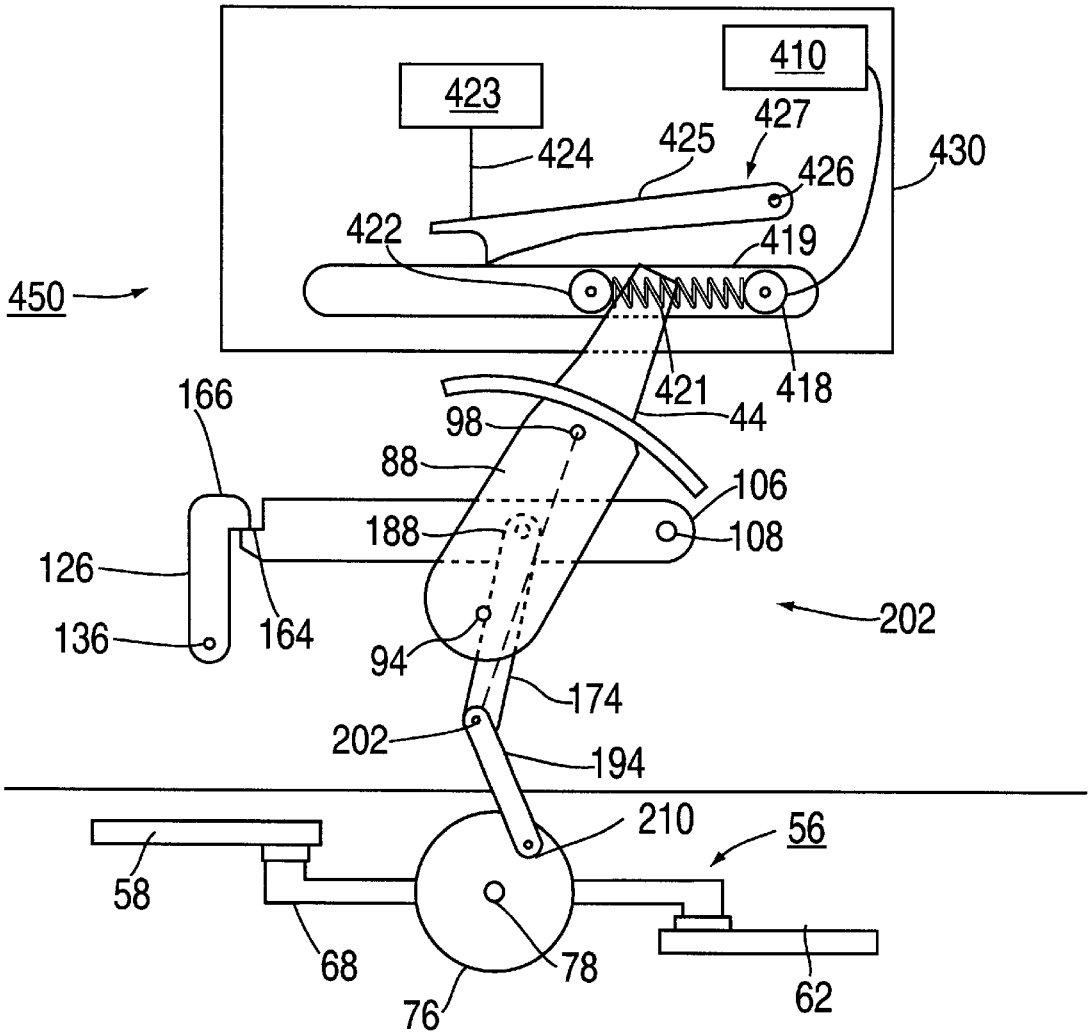
FIG. 9 is a schematic diagram of a motor operator and a circuit breaker of the present apparatus in the reset and closed positions.

FIG. 8 shows a motor operator and circuit breaker preparing to close. A drive system 410 operates a drive pin 418 to pull away from a first pin 422 connected to the drive pin 418 with a spring 421, the drive pin 418 and second pin 422 are disposed on either side of a breaker handle within an interface between the motor operator and circuit breaker, wherein the drive pin 418 and first pin 422 motion is guided within a slot 419. As the drive pin 418 moves further away from the first pin 422, the spring 421 connecting both pins tensions causing the first pin 422 to exert increasing force on the breaker handle 44 and rotate the breaker handle 44 and connected handle yoke 88 clockwise about the bearing portion 94. The clockwise rotation of the handle yoke 88 causes the mechanism spring 96 to extend, thus charging the mechanism spring 96 with closing energy. At the position shown in FIG. 8, the pin latch 425 contacts and contains the first pin 422 at a predetermined point before the circuit breaker closes. The predetermined point occurs just before the orientation of a lengthwise axis of the mechanism spring 96 (running through a spring anchor 98 for mechanism spring 96 on the handle yoke 88 and pin 202) coincides with a lengthwise axis of the upper link 174 (from pin 202 to pin 188).

The drive pin 418 continues to move as the first pin 422 is blocked by the pin latch 425, causing the at least one spring 421 connecting the drive pin 418 and first pin 422 to further lengthen, thereby storing a closing energy to move the breaker handle 44 to the on position once the first pin 422 is allowed to move. The force required to move the breaker handle from this predetermined point is less than the force required to move the breaker handle 44 at a point closer to an "off" position by minimizing the moment arm keeping the circuit breaker open. The reduced force required to move the breaker handle takes advantage of the reduced moment arm "w" discussed below in this predetermined position and an "over-center" point that refers to a mechanism spring 96 axis between spring anchor 98 and pin 202 coinciding with an axis formed between pin 188 and pin 202.

Turning to FIG. 6, the present apparatus allows the breaker handle 44 to move in a closing direction under bias of a first pin 422 until a predetermined point illustrated in an initial open position 266 and further depicted when line "y" is just to the left of the pin 188. As mentioned above, when the breaker handle 44 is rotated from open position 263 to the initial open position 266, the "z" distance increases, creating greater closing force output within the mechanism spring 96. The closing spring force is always directed through the anchor points of springs 96, spring anchor 98 and pin 202, as depicted by line "y". However, in position 266, the line "y" does not pass the right of upper link pivot pin 188, and the line of forces generated by mechanism spring 96 (i.e., between spring anchor 98 and pin 202) is to the left of bearing portion 94 (as oriented in FIGS. 3–5) and to the left of pin 188 (as oriented in FIG. 9), causing the upper link 174 to rotate in a clockwise direction about pin 188 and open the contact arm 68 as described hereinbefore with reference to FIG. 3. When the line "y" is disposed marginally left of upper link pivot pin 188 as in initial open position 266, a moment arm of length "w" is created perpendicular to line "y" and through the center of pin 188. The relatively small moment arm "w" causing the contacts to remain open is overcome when the biased first pin is allowed to exert enough force to overcome the moment arm in initial open position 266 and move the breaker handle 44 to position 264, which in turn allows the contacts to close as discussed above.

The present apparatus allows the contacts 64, 72, 74, and 66 to close with a first pin 422 exerting a force on the breaker handle 44 in a closing direction, but is blocked with a pin latch 425 from exerting this force at a predetermined distance intermediate to the off and on positions until released. When the first pin is released, the distance to close is shorter and there is an accompanying increase in closing speed due to the shorter close stroke. The present apparatus utilizes a motor operator unit to control the "on", "off", and "reset" functions of a circuit breaker and reduces the force on the breaker handle to control these functions, and thereby reduces the applied force to the contacts when closing the circuit.

The reduced force required to move the breaker handle 44 from the predetermined point occurs when the handle yoke 88 connected to the breaker handle 44 and the mechanism spring 96 line up just before the over-center point for the mechanism spring 96 and therefore a minimal amount of force is needed to move the handle yoke 88 past the over-center point, wherein the mechanism spring 96 will cause the rotary contact assembly 56 to rotate clockwise about common center 78, thus closing the circuit breaker.

To close the breaker contacts 72 and 74, a close mechanism 423 attachable to the motor operator pivots pin latch 425 in a direction opposite of its bias via link 424, thus releasing first pin 422. First pin 422 by action of the spring 421 moves the breaker handle 44 and attached handle yoke 88 to a full clockwise position about bearing portion 94 to the position shown in FIG. 9. Once the breaker mechanism spring 96 over-centers, the breaker mechanism spring 96 will cause the upper link 174 to pivot counter clockwise about pin 188. When the upper link 174 is driven counter clockwise, the lower link 194 is driven against the pivotal rivet 210, thus rotating the rotary contact assembly 56 clockwise into contact with the line strap 62 and the load strap 58 establishing a closed electrical circuit.

The apparatus as described provides for reduced closing times due to efficient utilization of the circuit breaker mechanism spring and the reduced operating motion to move the breaker handle to the "on" position. The apparatus also allows a reduction in the size of a motor operator, as the required stored energy is significantly reduced due to a shorter closing stroke and thereby the motor operator may be reduced in size because less energy is required to close the circuit eliminating the need for larger springs to store the customary closing energy. The reduced closing energy required will also require a smaller sized electrical charging system that will place less demands on the motor operator control system yielding greater operating efficiency. Lastly, the use of less closing energy reduces the mechanical stress on both the motor operator and the circuit breaker.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A motor operator mechanism for moving a breaker handle of a circuit breaker between off and on positions, said motor operator mechanism comprising:

a first pin biased to engage said breaker handle in a direction to close said circuit breaker;

a pin latch configured to releasably engage said first pin when said breaker handle is in a position intermediate to said off and on positions, wherein releasing said pin latch allows said first pin to move said breaker handle to the on position.

2. The motor operator mechanism of claim 1 further including:

a drive pin; and a spring extending between said drive pin and said first pin, said drive pin moves causing said first pin to engage said breaker handle moving said breaker handle from said off position to said on position.

3. The motor operator mechanism of claim 1 further comprising:

a close mechanism to operably move said pin latch.

4. The motor operator mechanism of claim 1 further comprising:

a drive system to operably move said drive pin.

5. The motor operator mechanism of claim 1 wherein said pin latch includes:

a first end; and a second end opposite said first end, said second end releasably engages said first pin, and said pin latch pivots about said first end.

6. The motor operator mechanism of claim 5 wherein said second end is configured to engage and retain said first pin.

7. A motor operated circuit breaker comprising:

a breaker handle;

a first contact operably connected to said breaker handle;

a second contact proximate to said first contact;

stationary contacts for electrical connection with said first contact and said second contact;

a motor operator for moving said breaker handle between off and on positions, said first and second contacts are separated in said off position and said first and second contacts are closed in said on position;

a first pin biased to engage said breaker handle in a direction to close said first and second contacts;

a pin latch configured to releasably engage said first pin when said breaker handle is in a position intermediate to said off and on positions, wherein releasing said pin latch allows said first pin to move said handle to close said first and second contacts.

8. The motor operated circuit breaker of claim 7 further including:

a drive pin; and a spring extending between said drive pin and said first pin, said drive pin moves causing said first pin to engage said breaker handle moving said breaker handle from said off position to said on position.

9. The motor operated circuit breaker of claim 7 further comprising:

a close mechanism to operably move said pin latch.

10. The motor operated circuit breaker of claim 7 further comprising:

a drive system to operably move said drive pin.

11. The motor operated circuit breaker of claim 7 wherein said pin latch includes:

a first end; and a second end opposite said first end, said second end releasably engages said first pin, and said pin latch pivots about said first end.

12. The motor operated circuit breaker of claim 11 wherein said second end is configured to engage and retain said first pin.

13. A motor operator mechanism for moving a breaker handle of a circuit breaker between off and on positions, said motor operator mechanism comprising:

a biased first means for engaging said breaker handle in a direction to close said circuit breaker;

a latch means for releasably engaging said first means when said breaker handle is in a position intermediate to said off and on positions, wherein releasing said latch means allows said first means to move said breaker handle to the on position.

14. The motor operator mechanism of claim 13 further including:

a drive means for driving said first means; and a biasing means for extending between said drive means and said first means, said drive means moves causing said first means to engage said breaker handle moving said breaker handle from said off position to said on position.

15. The motor operator mechanism of claim 13 further comprising:

a closing means for operably moving said latch means.

16. The motor operator mechanism of claim 13 further comprising:

a drive system means for operably moving said drive means.

* * * * *